US012365966B2

(12) United States Patent
Alfred et al.

(10) Patent No.: US 12,365,966 B2
(45) Date of Patent: Jul. 22, 2025

(54) NON-HEAT-TREATED CASTING ALLOYS FOR AUTOMOTIVE STRUCTURAL APPLICATIONS

(71) Applicant: MAGNA INTERNATIONAL INC., Aurora (CA)

(72) Inventors: Chris Alfred, Brampton (CA); Xiaoping Niu, Brampton (CA); Juergen Wuest, Markt Schwaben (DE); Randy Beals, Grand Ledge, MI (US)

(73) Assignee: MAGNA INTERNATIONAL INC., Aurora (CA)

( * ) Notice: Subject to any disclaimer, the term of this patent is extended or adjusted under 35 U.S.C. 154(b) by 662 days.

(21) Appl. No.: 17/604,500

(22) PCT Filed: Apr. 16, 2020

(86) PCT No.: PCT/US2020/028406

§ 371 (c)(1),
(2) Date: Oct. 18, 2021

(87) PCT Pub. No.: WO2020/214750

PCT Pub. Date: Oct. 22, 2020

(65) Prior Publication Data

US 2022/0213580 A1 Jul. 7, 2022

Related U.S. Application Data

(60) Provisional application No. 62/836,207, filed on Apr. 19, 2019.

(51) Int. Cl.
*C22C 21/10* (2006.01)
*C22C 21/02* (2006.01)

(52) U.S. Cl.
CPC ..... *C22C 21/10* (2013.01); *C22C 21/02* (2013.01)

(58) Field of Classification Search
CPC ..... C22C 21/02; C22C 21/10; C22C 21/06; C22C 21/08; C22F 1/043; C22F 1/047; C22F 1/053
See application file for complete search history.

(56) References Cited

U.S. PATENT DOCUMENTS

| | | | | |
|---|---|---|---|---|
| 3,287,185 | A | 11/1966 | Vachet et al. | |
| 3,490,955 | A | 1/1970 | Winter et al. | |
| 6,132,521 | A | 10/2000 | Gupta et al. | |
| 2013/0334091 | A1 * | 12/2013 | Sawtell | C22F 1/047 148/439 |
| 2015/0020930 | A1 | 1/2015 | Kamat et al. | |
| 2015/0315688 | A1 | 11/2015 | Doty | |
| 2018/0298471 | A1 | 10/2018 | Matthies et al. | |

FOREIGN PATENT DOCUMENTS

| | | | | |
|---|---|---|---|---|
| CN | 103627933 | A | 3/2014 | |
| CN | 104988368 | A | 10/2015 | |
| CN | 105986152 | A | 10/2016 | |
| CN | 106945895 | A * | 7/2017 | C22C 21/02 |
| DE | 102015013540 | A1 | 4/2017 | |
| EP | 730040 | A1 * | 9/1996 | B60B 3/06 |
| EP | 2263811 | A1 * | 12/2010 | C22B 21/06 |
| GB | 2568095 | A | 5/2019 | |
| WO | 9630554 | A1 | 10/1996 | |
| WO | 2018156902 | A1 | 8/2018 | |

OTHER PUBLICATIONS

English Abstract and English Machine Translation of Xiao et al. (CN 106947895) (Jul. 14, 2014).*
EP Communication; European Patent Office; Nov. 17, 2022; 9 pgs.
First Chinese Office Action with English translation mailed Apr. 8, 2022 for Chinese Application No. 202080029439.0, 22 pages.
Feng, "Castiing Alloys and Melting Technology," Metallurgical Industry Press, Dec. 2013; No English Translation Available.

* cited by examiner

*Primary Examiner* — Jessee R Roe
(74) *Attorney, Agent, or Firm* — Dickinson Wright PLLC

(57) ABSTRACT

An aluminum alloy for die casting parts used in automotive structural applications is provided. According to example embodiments, the alloy includes 0.6 to 2.0 wt. % manganese, 0.5 to 4.0 wt. % magnesium, 0.0 to 1.0 wt. % iron, 0.0 to 3.0 wt. % zinc, 0.0 to 3.0 wt. % silicon, 0.0 to 1.0 wt. % zirconium, 0.0 to 0.5 wt. % titanium and/or boron, 0.0 to 0.05 wt. % strontium, and 85.5 to 98.8 wt. % aluminum, based on the total weight of the aluminum alloy. The alloy maintains good characteristics during the casting process, including fluidity, manageable hot cracking, and anti-soldering. The alloy casting does not require a heat treatment process after the casting step to achieve acceptable mechanical properties. The aluminum alloy casting has a yield strength of at least 90 MPa, an ultimate tensile strength of at least 180 MPa, and an elongation equal to or greater than 10% without heat treatment.

7 Claims, 11 Drawing Sheets

| Test # | Mn | Fe | Mg | Zn | Zr | Ti | Si | Sr | | YS | UTS | E% |
|---|---|---|---|---|---|---|---|---|---|---|---|---|
| C611 | 0.58 | 0.13 | 0.13 | - | - | 0.06 | 6.6 | - | | 130 | 246 | 12 |
| 1 | | | | | 0 | | | - | | 100 | 191 | 30 |
| 2 | | | | | 0.6 | | | - | | 98 | 190 | 29 |
| 3 | | | | 1.5 | | 0.2 | | - | | 91 | 190 | 30 |
| 4 | | | 1 | | | | 2.5 | - | | 150 | 253 | 10 |
| 5 | | | | | | | | - | | 107 | 201 | 24 |
| 6 | 1.8 | 0.2 | | | 0.6 | | | - | | 130 | 223 | 18 |
| 7 | | | | 3 | | 0.2 | | - | | 103 | 206 | 30 |
| 8 | | | | | | | 2.5 | - | | 159 | 252 | 8 |
| 9 | | | 1.5 | 1.5 | 0.3 | | | - | | 128 | 239 | 26 |
| 10 | | | 1 | 1.5 | | | 1.5 | - | | 178 | 261 | 6 |

F-Temper (As-Cast) Data

FIG. 1

| Test# | Si | Fe | Mn | Mg | Zn | Ti | B | Zr | Sr |
|---|---|---|---|---|---|---|---|---|---|
| C611 | 6.59 | 0.12 | 0.58 | 0.13 | 0.01 | 0.06 | 0.00 | 0.00 | 0.00 |
| A1 | 0.02 | 0.14 | 1.80 | 1.06 | 1.41 | 0.00 | 0.00 | 0.00 | 0.00 |
| A2 | 0.03 | 0.18 | 1.81 | 1.00 | 1.46 | 0.01 | 0.00 | 0.60 | 0.00 |
| A3 | 0.04 | 0.16 | 1.81 | 0.97 | 1.42 | 0.18 | 0.11 | 0.00 | 0.00 |
| A4 | 2.42 | 0.18 | 1.79 | 0.95 | 1.52 | 0.00 | 0.00 | 0.00 | 0.00 |
| A5 | 0.02 | 0.19 | 1.87 | 1.02 | 3.04 | 0.00 | 0.00 | 0.00 | 0.00 |
| A6 | 0.08 | 0.15 | 1.79 | 1.05 | 3.02 | 0.00 | 0.00 | 0.60 | 0.00 |
| A7 | 0.05 | 0.16 | 1.78 | 1.02 | 2.91 | 0.20 | 0.11 | 0.00 | 0.00 |
| A8 | 2.46 | 0.17 | 1.81 | 1.05 | 3.00 | 0.00 | 0.00 | 0.00 | 0.00 |
| A9 | 0.05 | 0.19 | 1.75 | 1.50 | 1.50 | 0.01 | 0.00 | 0.30 | 0.00 |
| A10 | 1.57 | 0.21 | 1.74 | 1.44 | 1.47 | 0.00 | 0.00 | 0.00 | 0.00 |

FIG. 2

FIG. 5A
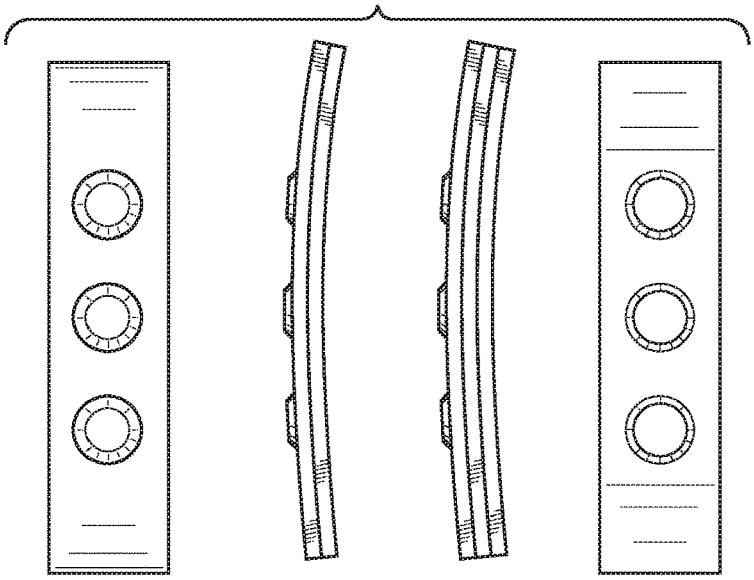
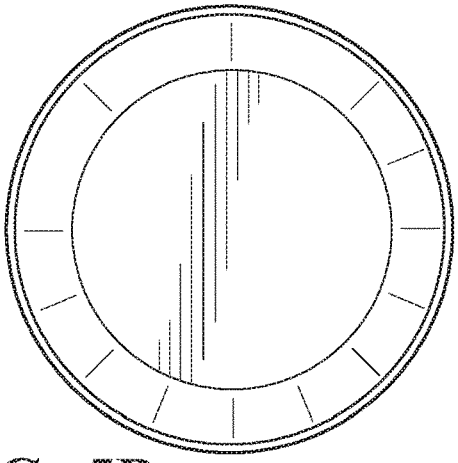
FIG. 5B
Average # of Cracks on SPR Button
| | 2T | 3T |
|---|---|---|
| A1 | 0 | 0 |
| A2 | 0 | 0 |
| A3 | 0 | 0 |
| A4 | 6 | 5 |
| A5 | 0 | 0 |
| A6 | 0 | 0 |
| A7 | 0 | 0 |
| A8 | 6 | 3 |
| A9 | N/A | 0 |
| A10 | N/A | 5 |
| C611 | 7 | 8 |
FIG. 5C
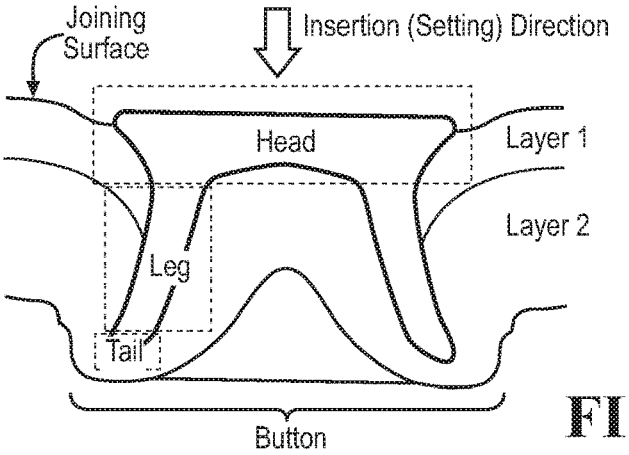
FIG. 5D

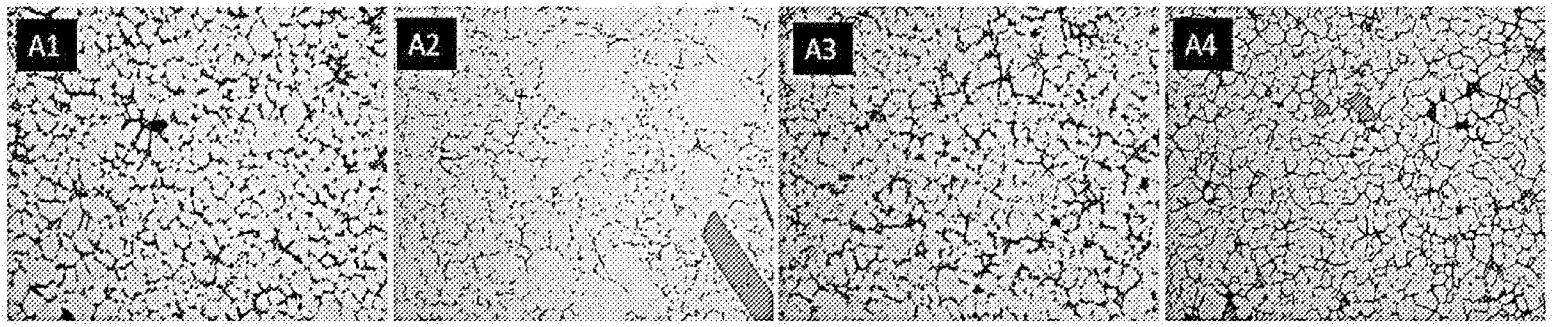
FIG. 7A
FIG. 7B
FIG. 7C
FIG. 7D
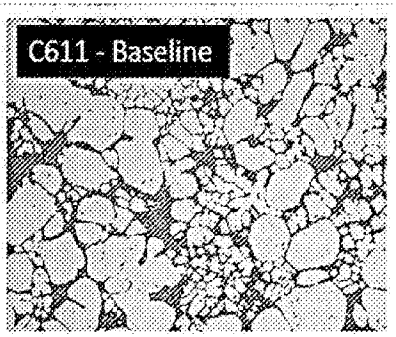
FIG. 7E
FIG. 7F
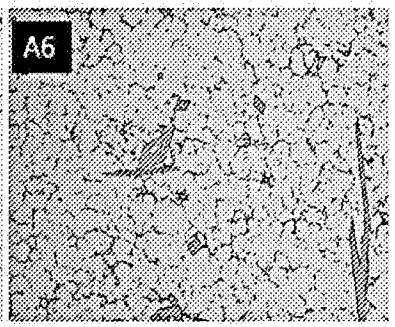
FIG. 7G
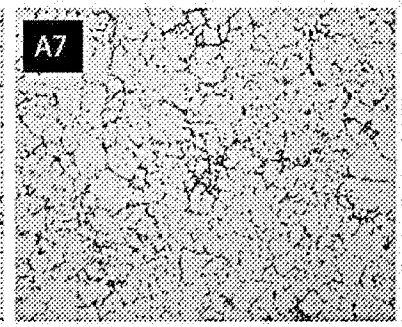
FIG. 7H
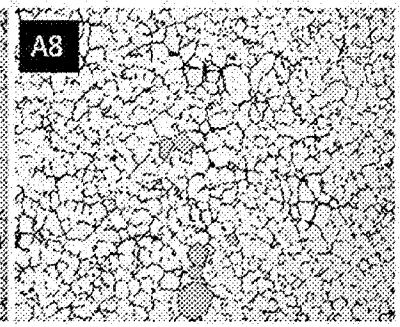
FIG. 7I FIG. 8A
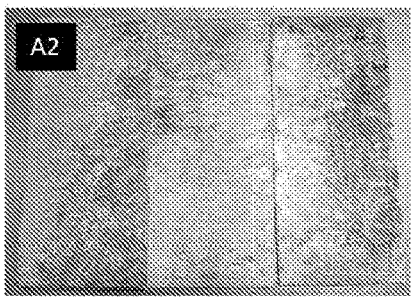
FIG. 8B
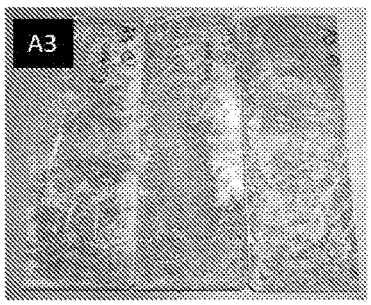
FIG. 8C
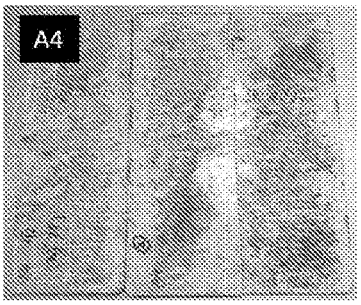
FIG. 8D
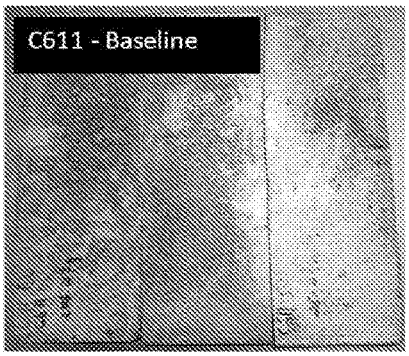
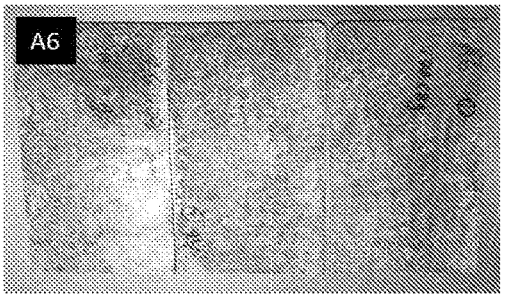
FIG. 8E
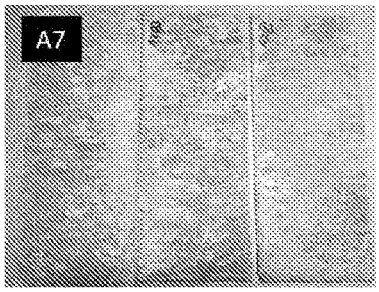
FIG. 8F
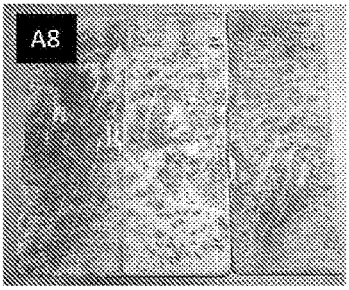
FIG. 8G
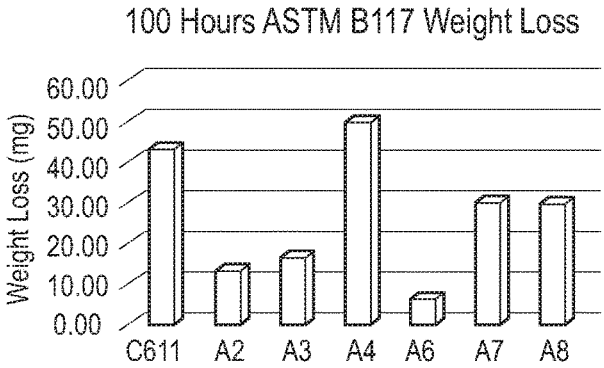
FIG. 8H

| Alloy | Die Filling | Sticking/Soldering | Hot Tearing | Shrinkage | Porosity | Overall Rating |
|---|---|---|---|---|---|---|
| C611 | 4 | 3 | 5 | 4 | 4 | 4 |
| A9 | 5 | 4 | 3 | 4 | 4 | 4 |

Rating: 1 = Worst, 5 = Best

FIG. 9

NON-HEAT-TREATED CASTING ALLOYS FOR AUTOMOTIVE STRUCTURAL APPLICATIONS

CROSS-REFERENCE TO RELATED APPLICATIONS

This U.S. National Stage Patent Application claims the benefit of PCT International Patent Application Serial No. PCT/US2020/028406 filed Apr. 16, 2020 entitled "NON-HEAT-TREATED CASTING ALLOYS FOR AUTOMOTIVE STRUCTURAL APPLICATIONS" which claims the benefit of and priority to U.S. Provisional Patent Application Ser. No. 62/836,207, filed Apr. 19, 2019, titled "Non-Heat-Treated Casting Alloys For Automotive Structural Applications," the entire disclosures of which are hereby incorporated by reference.

BACKGROUND OF THE INVENTION

1. Field of the Invention

The present invention relates to aluminum alloys, cast parts formed from aluminum alloys, and methods of manufacturing the cast parts.

2. Related Art

This section provides background information related to the present disclosure which is not necessarily prior art.

In the automotive industry, there is a high demand for structural castings formed of aluminum alloys due to weight and emission reduction initiatives. The aluminum alloy castings can be used as various automotive parts, such as front and rear shock towers, rails, battery trays, and parts for various other structural applications. The aluminum alloy castings typically pass through costly heat treatment and straightening operations to obtain required mechanical properties and dimensions. Currently known aluminum alloys that do not require a high temperature heat treatment process after casting do not achieve an elongation and castability comparable to the heat-treated aluminum alloy castings. An aluminum alloy which does not require a heat treatment process after casting yet has physical properties similar to or better than those of the heat-treated aluminum alloy castings is desired.

SUMMARY

This section provides a general summary of the inventive concepts associated with this disclosure and is not intended to be interpreted as a complete and comprehensive listing of all of its aspects, objectives, features, and advantages.

One aspect of the invention provides an aluminum alloy which can be cast to achieve a yield strength of at least 90 MPa, an ultimate tensile strength of at least 180 MPa, and an elongation of at least 10%, without any heat treatment. The aluminum alloy comprises, based on the total weight of the aluminum alloy, manganese in an amount of 0.6 to 2.0 wt. %, magnesium in an amount of 0.5 to 4.0 wt. %, iron in an amount of 0.0 to 1.0 wt. %, zinc in an amount of 0.0 to 3.0 wt. %, silicon in an amount of 0.0 to 3.0 wt. %, zirconium in an amount of 0.0 to 1.0 wt. %, at least one of titanium and boron in an amount of 0.0 to 0.5 wt. %, strontium in an amount of 0.0 to 0.05 wt. %, and aluminum in an amount of 85.5 to 98.8 wt. %.

Another aspect of the invention provides a cast part formed of the aluminum alloy. The aluminum alloy comprises, based on the total weight of the aluminum alloy, manganese in an amount of 0.6 to 2.0 wt. %, magnesium in an amount of 0.5 to 4.0 wt. %, iron in an amount of 0.0 to 1.0 wt. %, zinc in an amount of 0.0 to 3.0 wt. %, silicon in an amount of 0.0 to 3.0 wt. %, zirconium in an amount of 0.0 to 1.0 wt. %, at least one of titanium and boron in an amount of 0.0 to 0.5 wt. %, strontium in an amount of 0.0 to 0.05 wt. %, and aluminum in an amount of 85.5 to 98.8 wt. %.

Yet another aspect of the invention provides a method of manufacturing a cast part. The method includes casting an aluminum alloy to form a cast part. The aluminum alloy includes manganese in an amount of 0.6 to 2.0 wt. %, magnesium in an amount of 0.5 to 4.0 wt. %, iron in an amount of 0.0 to 1.0 wt. %, zinc in an amount of 0.0 to 3.0 wt. %, silicon in an amount of 0.0 to 3.0 wt. %, zirconium in an amount of 0.0 to 1.0 wt. %, at least one of titanium and boron in an amount of 0.0 to 0.5 wt. %, strontium in an amount of 0.0 to 0.05 wt. %, and aluminum in an amount of 85.5 to 98.8 wt. %.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein:

FIG. 1 is a Table listing compositions and mechanical properties of aluminum alloys according to example embodiments (1-10) and also an aluminum alloy according to a comparative embodiment (C611);

FIG. 2 is a Table listing compositions of aluminum alloys according to example embodiments (A1-A10) and also an aluminum alloy according to a comparative embodiment (C611) which were all tested for elongation and yield strength;

FIGS. 5A-5D and 6A-6D include results of a self-piercing rivet test conducted on as cast aluminum alloys listed in the Table of FIG. 2;

FIGS. 7A-7I show microstructures of aluminum alloy castings having compositions listed in FIG. 2 at 500× magnification;

FIG. 8A-8H shows surface appearance and weight loss of aluminum alloy castings having compositions listed in FIG. 2 in milligrams after 100 hours exposure to ASTM B117 salt spray; and FIG. 9 includes the results of a castability assessment conducted on aluminum alloys having compositions listed in FIG. 2.

DESCRIPTION OF EXAMPLE EMBODIMENTS

Figure 3:
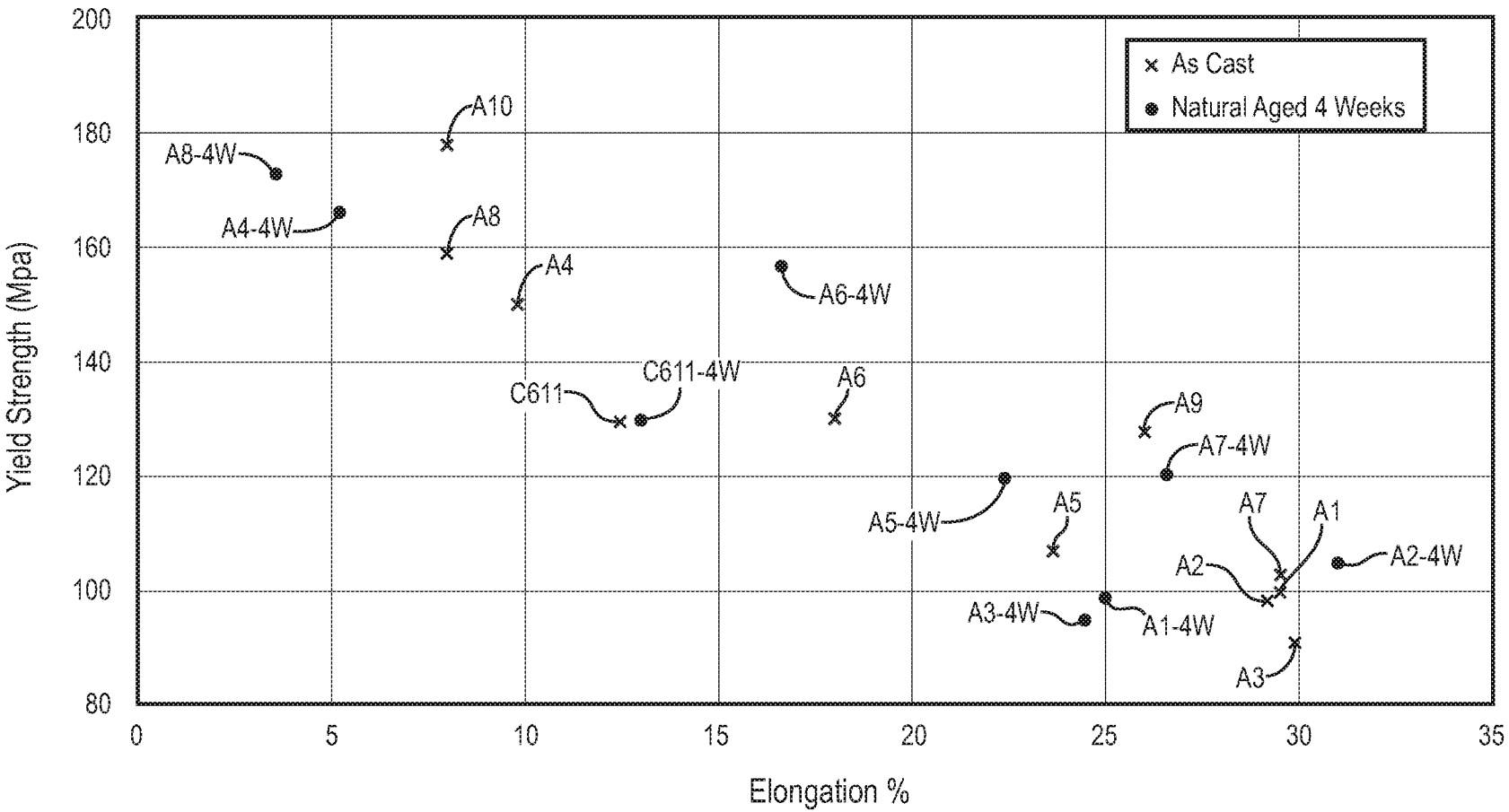
FIG. 3 includes a graph of elongation % versus yield strength for the aluminum alloys listed in the Table of FIG. 2 in the as cast condition and after 4 weeks of natural aging.

Example embodiments will now be described more fully with reference to the accompanying drawings. However, the example embodiments are only provided so that this disclosure will be thorough, and will fully convey the scope to those who are skilled in the art. It will be apparent to those skilled in the art that specific details need not be employed, that example embodiments may be embodied in many different forms and that neither should be construed to limit the scope of the disclosure.

One aspect of the invention provides an aluminum alloy for die casting parts used in automotive structural applications. The aluminum alloy includes manganese, magnesium, iron, and zinc. The aluminum alloy preferably includes additions of zirconium, titanium and/or boron, silicon, and/or strontium, or any combination of these additional elements. The aluminum alloy also includes a balance of aluminum and possibly impurities in an amount not greater than 1.0 wt. %. The aluminum alloy can be referred to as an aluminum-manganese (Al—Mn) alloy system. The manganese of the aluminum alloy improves elongation. The manganese and iron can reduce die soldering during the casting process. The magnesium and/or zinc may provide solid solution strengthening. The zirconium or titanium diboride may provide fine grain strengthening.

The aluminum alloy maintains good characteristics during the casting process, including fluidity, manageable hot cracking, and anti-soldering. Further, due to the low amount or absence of silicon, the aluminum alloy casting does not require a heat treatment process, which at minimum would include heating the aluminum alloy casting to a temperature of at least 215° C. for at least 60 minutes (for example, a T5 treatment), and/or a paint bake cure cycle which at minimum would include heating to a temperature of at least 100° C. for at least 20 minutes. The heat treatment process is not required to achieve the acceptable mechanical properties. In other words, a production step related to heat treatment is not critical to the resulting mechanical properties, which is not the case for comparative AlSiMg (300 series) alloys. The mechanical properties achieved by the aluminum alloy casting, without the heat treatment or the paint bake cure cycle, include a yield strength of at least 90 MPa, an ultimate tensile strength of at least 180 MPa, and an elongation equal to or greater than 10%. The yield strength, ultimate tensile strength, and elongation were determined according to ASTM E8.

According to some embodiments, the aluminum alloy casting has a yield strength of at least 110 MPa, in addition to the ultimate tensile strength of at least 180 MPa, and the elongation of greater than 10%. A T5 heat treatment process is not conducted on the aluminum alloy casting of the invention, which typically includes heating the casting to a temperature of 215° C. for 60 minutes. A T7 heat treatment process is also not conducted on the aluminum alloy casting of the invention, which typically includes solution heat-treating the casting at a temperature over 450° C. for greater than 40 minutes, quenching in forced air, and artificial aging at a temperature of 215° C. for 60 min.

The mechanical and casting properties of the aluminum alloy according to some embodiments of the invention meet or exceed those of comparative aluminum alloy castings subject to a heat treatment process, which includes heating the aluminum alloy casting to a temperature of at least 215° C. for at least 60 minutes. The casting properties include good fluidity, manageable hot cracking, and anti-soldering. The cast aluminum alloy also has good ductility and has properties suitable for being subjected to self-piercing rivets.

Significant cost savings are achieved by avoiding the heat treatment process, for example by eliminating or reducing heat treatment ovens, racking, energy consumption, human resources, and plant space. Also, since the aluminum alloy does not undergo the T7 heat treatment, the distortion of the part typically caused by the T7 heat treatment process is avoided. A straightening operation after the casting process may not be required. The manufacturing process would include moving the aluminum alloy directly from a die casting process to a machining process to final quality assurance and delivery to the customer.

According to an example embodiment, the aluminum alloy includes, based on the total weight of the aluminum alloy, manganese in an amount of 0.6 to 2.0 weight percent (wt. %), magnesium in an amount of 0.5 to 4.0 wt. %, iron in an amount of 0.0 to 1.0 wt. %, zinc in an amount of 0.0 to 3.0 wt. %, silicon in an amount of 0.0 to 3.0 wt. %, zirconium in an amount of 0 to 1.0 wt. %, titanium-boron in an amount of 0.0 to 0.5 wt. %, strontium in an amount of 0.0 to 0.05 wt. %, and a balance of aluminum, except for possible impurities, for example aluminum in an amount of 85.5 to 98.8 wt. %.

According to another example embodiment, the aluminum alloy includes, based on the total weight of the aluminum alloy, manganese in an amount of 1.2 to 2.0 wt. %, magnesium in an amount of 0.5 to 4.0 wt. %, iron in an amount of 0.0 to 1.0 wt. %, zinc in an amount of 0.3 to 3.0 wt. %, silicon in an amount of 0.0 to 3.0 wt. %, zirconium in an amount of 0.1 to 1.0 wt. %, at least one of titanium and boron in an amount of 0.0 to 0.5 wt. %, strontium in an amount of 0.0 to 0.05 wt. %, and aluminum in an amount of 85.5 to 98.8 wt. %.

According to another example embodiment, the aluminum alloy includes, based on the total weight of the aluminum alloy, manganese in an amount of 1.7 to 1.9 wt. %, for example 1.8 wt. %, magnesium in an amount of 1.0 to 1.5 wt. %, iron in an amount of 0 to 0.2 wt. %, zinc in an amount of 1.5 to 3.0 wt. %, silicon in an amount of 0 to 2.5 wt. %, zirconium in an amount of 0 to 0.6 wt. %, titanium-boron in an amount of 0 to 0.2 wt. %, strontium in an amount of 0.0 to 0.05 wt. %, and a balance of aluminum except for possible impurities, for example aluminum in an amount of 85.5 to 98.8 wt. % or 90.1 to 98.8 wt. %.

More specific example compositions of the aluminum alloy are disclosed in FIG. 1 and are labeled 1-10. In FIG. 1, the amount of each element is in wt. %, based on the total weight of the aluminum alloy. These example aluminum alloy compositions include manganese in an amount of 1.8 wt. %, magnesium in an amount of 1.0 to 1.5 wt. %, iron in an amount of 0.2 wt. %, zinc in an amount of 1.5 to 3.0 wt. %, silicon in an amount of 0 to 2.5 wt. %, zirconium in an amount of 0 to 0.6 wt. %, titanium in an amount of 0.0 to 0.2 wt. %, and a balance of aluminum, except for possible impurities.

FIG. 1 also provides the mechanical properties of the example aluminum alloys 1-10 in an F-temper condition, which is after casting and without a heat treatment or paint bake cure process, including yield strength, ultimately tensile strength, and elongation. FIG. 1 also provides the composition and mechanical properties of a comparative aluminum alloy, labeled C611, after casting and without a heat treatment or paint bake cure process. The yield strength, ultimate tensile strength, and elongation were determined according to ASTM E8.

Additional example compositions of the aluminum alloy are disclosed in the Table of FIG. 2. These example aluminum alloy compositions include manganese in an amount of 1.74 to 1.87 wt. %, magnesium in an amount of 0.95 to 1.5 wt. %, iron in an amount of 0.14 to 0.21 wt. %, zinc in an amount of 1.41 to 3.04 wt. %, silicon in an amount of 0.02 to 2.46 wt. %, zirconium in an amount of 0 to 0.6 wt. %, titanium in an amount of 0.0 to 0.2 wt. %, boron in an amount of 0.0 to 0.11 wt. %, strontium in an amount of 0.0 wt. %, and a balance of aluminum, except for possible impurities.

Another aspect of the invention provides the cast part formed of the aluminum alloy. The cast part is typically used in an automotive vehicle, for example as a front or rear shock tower, rail, battery tray, or another type of part for an automotive structural application. The aluminum alloy performs well during the casting process, and the cast part does not undergo the heat treatment or paint bake cure process after the casting operation. According to some embodiments, the cast part has mechanical properties similar to cast parts formed of comparable aluminum alloys which have undergone the heat treatment process.

The cast part formed of the aluminum alloy has a yield strength of at least 90 MPa, an ultimate tensile strength of at least 180 MPa, and an elongation equal to or greater than 10%, tested according to ASTM E8. The cast part has the yield strength of at least 90 MPa, the ultimate tensile strength of at least 180 MPa, and the elongation equal to or greater than 10% immediately after casting and without heat treatment or a paint bake cure cycle. According to some embodiments, the cast part has a yield strength of at least 110 MPa, in addition to the ultimate tensile strength of at least 180 MPa and the elongation of greater than 10%. The cast part can be formed of one of the aluminum alloys listed in the Table of FIG. 1 and would have the corresponding mechanical properties listed in FIG. 1. The cast part can also be formed of one of the aluminum alloys listed in the Table of FIG. 2 and would have the corresponding mechanical properties listed in FIG. 2.

Another aspect of the invention provides a method of manufacturing the cast part formed of the aluminum alloy. The casting step includes pouring the melted aluminum alloy into a mold, typically under high velocities and high pressures, and allowing the melted aluminum alloy to solidify. The casting of the aluminum alloy is typically conducted in a die apparatus. The yield strength of at least 90 MPa, the ultimate tensile strength of at least 180 MPa, and the elongation equal to or greater than 10% are achieved during the casting step. The method preferably does not include a heat treatment process after the casting step. The good mechanical properties of the cast part are present after the casting step and without the costly heat treatment process, or a paint bake cure cycle, which typically includes heating to a temperature of at least 215° C. for at least 60 minutes. The cast part of the present invention can undergo natural aging after the casting process. The cast part can also be subjected to some heat after the casting process and prior to assembly, but typically is not exposed to an amount of heat that could be considered a heat treatment, which would include a temperature of at least 215° C. for at least 60 minutes, or a paint bake cycle of at least 100° C. for at least 20 minutes. If the cast part is put through a paint bake before assembly, the cast part may be exposed to higher temperatures, but the paint bake process is not required to achieve the desired properties discussed above.

According to some embodiments, the cast part of the present invention can provide mechanical and casting properties similar to those of comparable cast aluminum alloys after those other cast aluminum alloys are subjected to a heat treatment process. For example, the aluminum alloy according to some embodiments of the present invention can have mechanical and physical properties similar to an AlSi10MgMn alloy, referred to as Aural 2 (C65K) after the AlSi10MgMn alloy is heated treated to a T7 condition (solution, forced air quench and artificial aging steps) to achieve an elongation greater than 10% and yield strength of greater than 110 MPa. The solution heat treatment is done at temperatures above 450° C. At this temperature, the casting usually distorts, and any trapped gas will expand in the material, potentially causing blister formation. If the distortion and blisters cannot be corrected, the cast parts are scrapped or remelted at a significant loss. The AlSi10MgMn alloy in an as cast (F temper) condition, without the costly heat treatment, has an elongation in the range of only 5-10%, depending on the thickness, and would not meet OEM requirements for certain joining methods for structural casting applications.

The cast aluminum alloy according to some embodiments of the present invention can also provide mechanical properties similar to an AlSi7MgMn alloy, referred to as C611, after the AlSi7MgMn alloy is heat-treated. Examples of the AlSi7MgMn alloy are disclosed in the Tables of FIGS. 1 and 2. The AlSi7MgMn alloy could be used in applications where the elongation requirement is about 8% in the as cast condition. As cast, the AlSi7MgMn alloy can achieve a yield strength greater 105 MPa. The yield strength can improved by 10-20 MPa without a significant drop in elongation, but only after a low temperature (T5 artificial aging) heat treatment for a short time period. Also, the AlSi7MgMn alloy with a lower eutectic phase could have poorer castability and fluidity.

The aluminum alloy casting according to some embodiments of the present invention can also perform better than other known non-heat-treated aluminum alloy castings, including an AlMg5Si2Mn alloy, referred to as Magismal59, and Al3.6Mg1.2Mn0.12Fe alloy, referred to as C446. These alloys can achieve yield strengths greater than 120 MPa and elongations of 8%. However, they have poor castability, higher shrinkage, problems with soldering, and hot tearing during the casting operation. Die life is typically reduced when the AlMg5Si2Mn alloy or Al3.6Mg1.2Mn0.12Fe alloy is used compared to the AlSi10MgMn alloy. Trials with this class of alloy have achieved minimal success in commercial production.

Example aluminum alloy compositions according to the invention and similar to the compositions listed in Table 1 were tested to evaluate mechanical and other performance characteristics. FIG. 2 includes a Table listing the compositions of the aluminum alloys tested. The tested aluminum alloy compositions according to the invention are labeled A1-A10. An AlSi7MgMn alloy composition similar to the comparative example (C611) listed in Table 2 was also tested for purposes of comparison. The aluminum alloys were tested within a short period of time after casting, and the aluminum alloys A1-A 10 were tested without having undergone a heat treatment process. In other words, after the aluminum alloys A1-A10 were cast, they were not exposed to a temperature of 100° C. or greater before the testing. The tested comparative aluminum alloy is again labeled C611 and was also tested in the as cast F Temper condition, without being exposed to a temperature of 100° C. or greater before the testing.

The as cast yield strength and elongation of the aluminum alloys listed in FIG. 2 were tested. Thus, the aluminum alloys according to the invention (A1-A10) were tested within 48 hours of being cast and were kept at room temperature, after the casting process and prior to testing. FIG. 3 includes a graph of elongation % versus yield strength for the as cast aluminum alloys tested. The test results show that the aluminum alloy composition A6 provides a preferably combination of elongation and yield strength. The aluminum alloy composition A6 includes about 3 wt. % zinc and about 0.6 wt. % zirconium. The aluminum alloy compositions A4 and A8, which include about 2.5 wt. % silicon, also have a good combination of elongation and yield strength. However, the aluminum alloy composition A8 has a lower elongation. The aluminum alloy compositions A1-A3, A5, and A7 have a high elongation, but lower yield strength.

The yield strength and elongation of the aluminum alloys listed in FIG. 2 after casting were also tested after four weeks of natural aging, which included maintaining the cast aluminum alloys at room temperature for four weeks after the casting process. FIG. 3 includes a graph of the elongation % versus yield strength for the aluminum alloys after four weeks of natural aging in air at room temperature. The test results show that the aluminum alloy compositions A5. A6, and A7 provide the most preferably combination of elongation and yield strength after natural aging. The aluminum alloy compositions A6 and A7 include approximately 3 wt. % zinc and include a grain refiner which is either zirconium or TiB. The aluminum alloy composition A5 has no grain refiner. The test results suggest that the amount of zirconium could be optimized between the amount in the A5 composition (0 wt. % zirconium) and the amount in the A6 composition (0.6 wt. % zirconium). The test results also suggest that the amount of silicon could be reduced in the aluminum alloy composition A4.

Figure 4A:
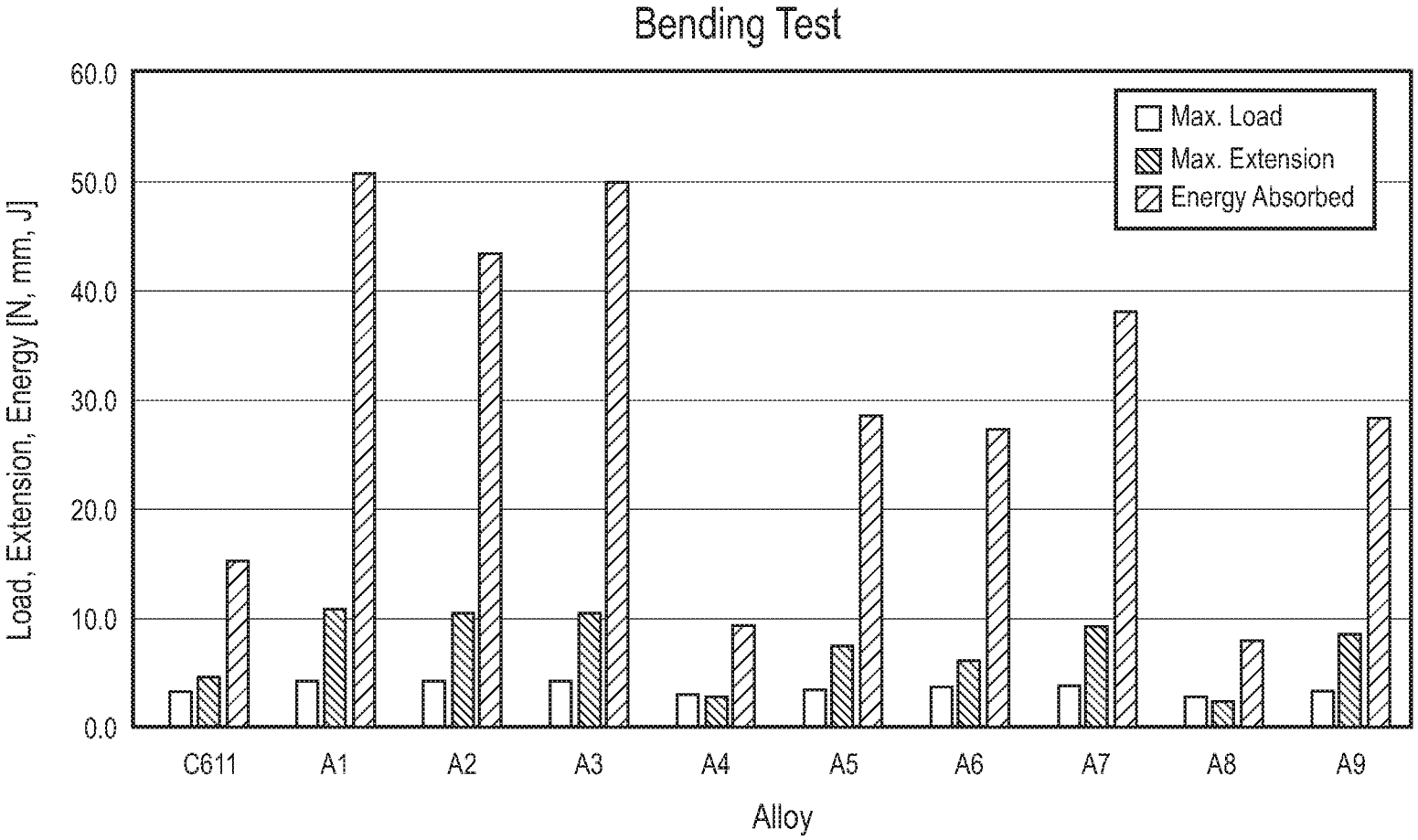
FIGS. 4A and 4B include graphs showing results of a bending test conducted on as cast aluminum alloys listed in the Table of FIG. 2.
Figure 4B:
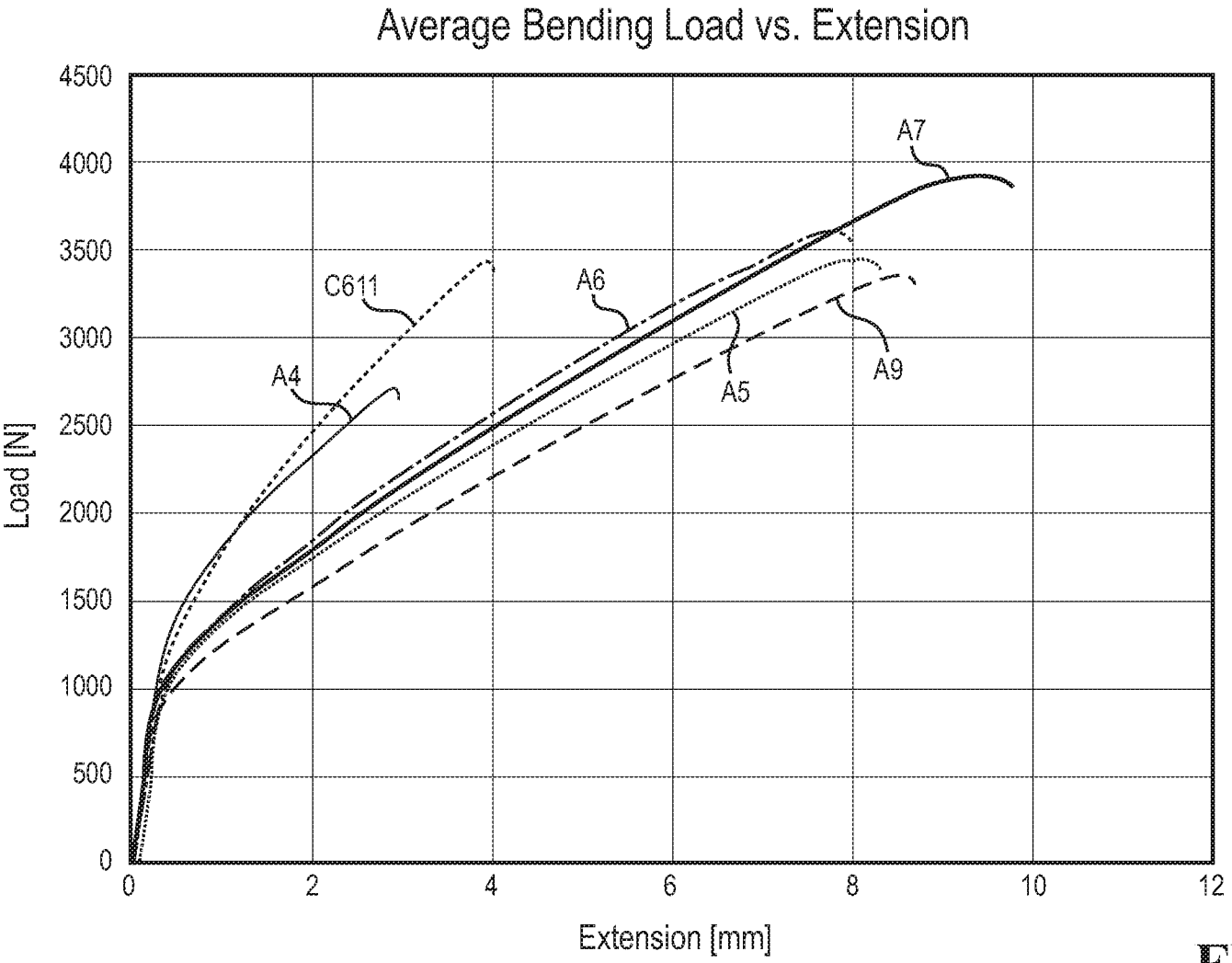
Figure 6A:
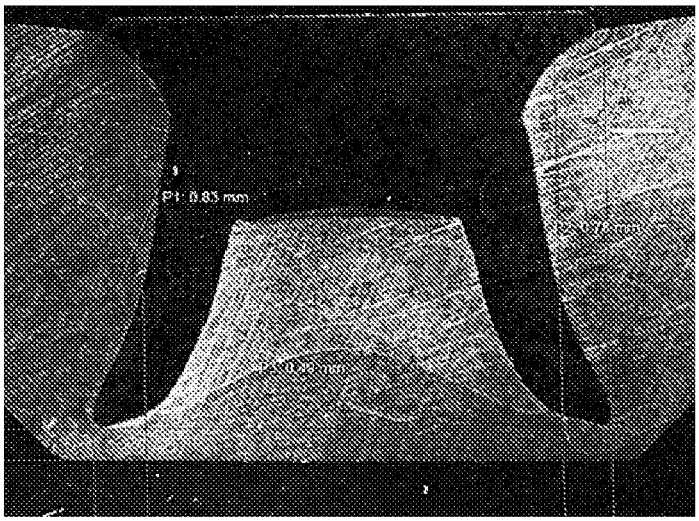
Figure 6B:
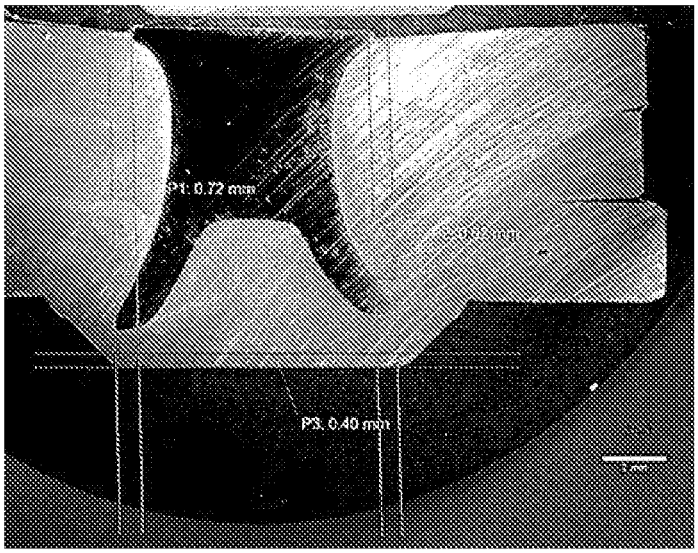
Figure 6C:
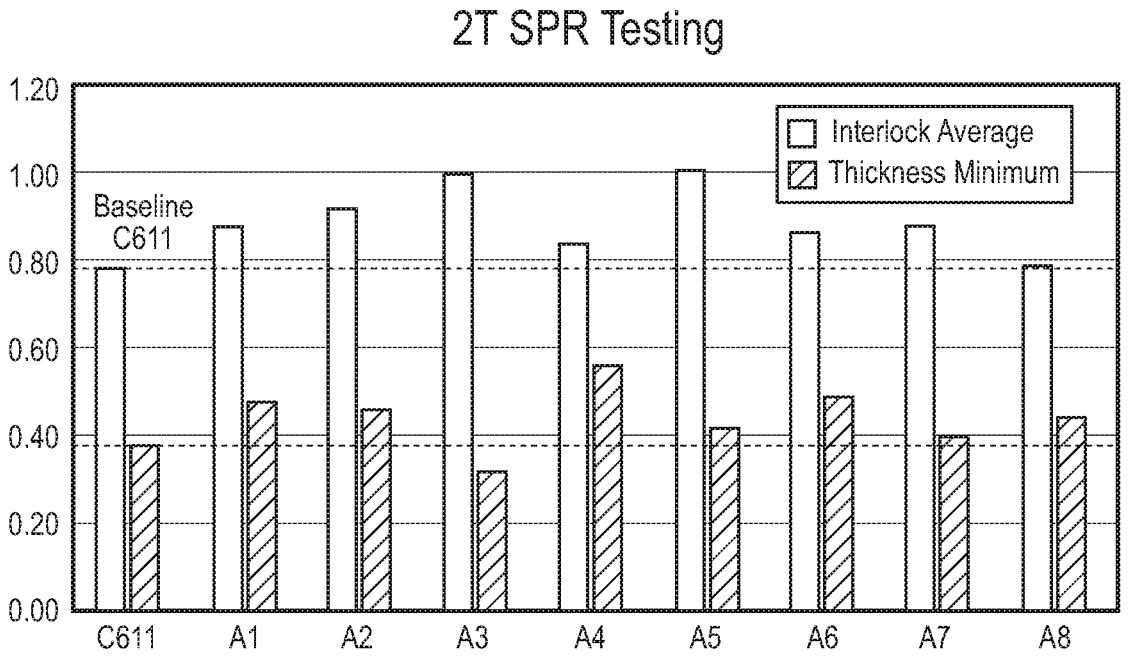
Figure 6D:
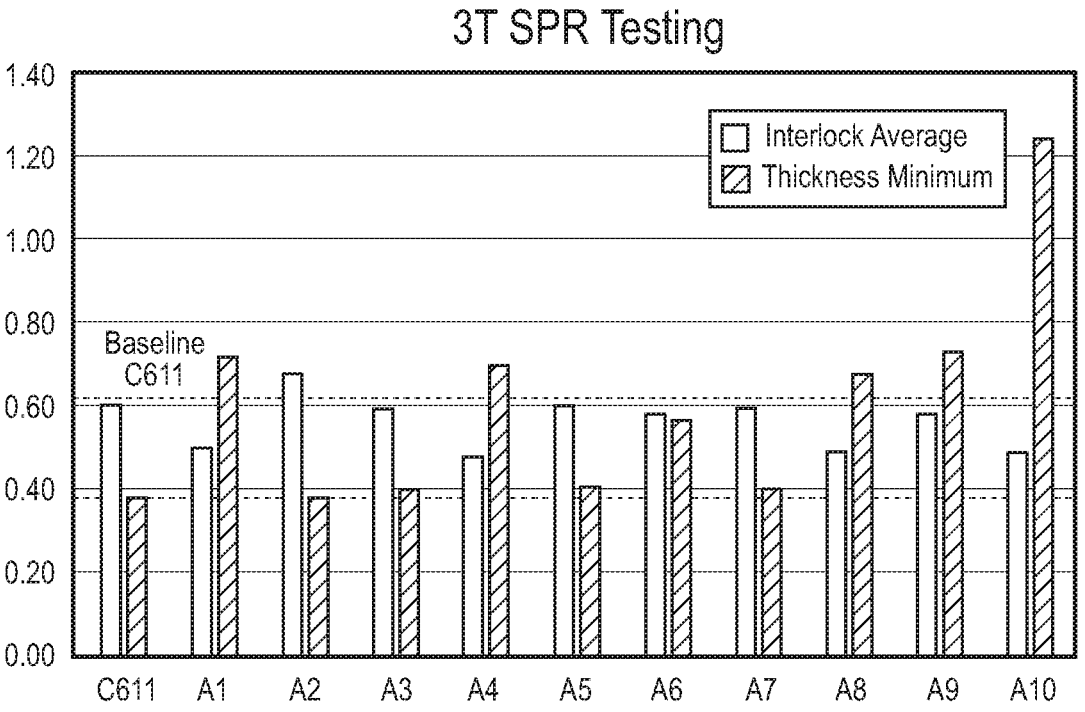

FIGS. 4A and 4B are graphs of the results of a bending test conducted on as cast aluminum alloys of FIG. 2. The bending test was conducted according to German specification VDA238-100. The test included a three point bending fixture on a tensile test unit with a coupon dimension of 60×30×3 mm. The results of the bending test illustrate that the energy absorbed in the cast aluminum alloys A1-A9 varies compared to those of the as cast aluminum alloy C611. Aside from A4 and A8, the other alloys absorbed higher energy then the C611. The load versus extension of the aluminum alloy compositions A4-A7 and A9 also showed the same trend when compared to the load versus extension of aluminum alloy C611.

A self-piercing rivet test, conducted according to the Stainley Tucker SPR Method, was performed on the cast aluminum alloys of FIG. 2, and the test results are provided in FIGS. 5A-5D and 6A-6D. The sample labeled 2T includes a 2.5 mm aluminum sheet coupon on top and a 3 mm casting plate coupon on the bottom. The sample labeled 3T includes two 2.5 mm aluminum sheet coupons on top and 3 mm one casting plate coupon on the bottom. AC300T61 is the type of sheet coupon used. The samples were subjected to self-piercing rivets. The aluminum alloy compositions A1-A10 in the as cast condition all exhibited superior ability to minimize any cracking after being pierced with the rivet in comparison to the cast C611 aluminum alloy. The cast C611 aluminum alloy in the as-cast condition showed cracks. The cast aluminum alloy compositions A4 and A8 also had cracks, which indicates eutectic modification may be required. Typically, the self-piercing rivets are required to achieve an interlock of greater than 0.4 mm, and a thickness of greater than 0.2 mm, and all samples tested met that requirement. FIGS. 5A-5C and 6A-6B are images of the samples tested, and FIGS. 5D, 5C, and 5D are graphs of the results.

FIGS. 7A-7I show the microstructures of the cast aluminum alloys having the compositions A1-A8 listed in FIG. 2 at 500× magnification.

FIGS. 8A-8G includes the results of an ASTM B117 salt spray corrosion test conducted on as cast aluminum alloys of FIG. 2. The corrosion test included a weight loss value for each alloy. The results of the corrosion test illustrate that the natural corrosion resistance in the cast aluminum alloys A2-A4 and A6-A8 varies compared to those of the as cast aluminum alloy C611. Aside from A4, the other alloys are more corrosion resistant than the as cast aluminum alloy C611. FIGS. 8A-8F are images of the samples tested, and FIG. 8G is a graph of the weight loss of each sample tested.

A castability assessment was also conducted to compare the aluminum alloy A9 to aluminum alloy C611, and the results are provided in FIG. 9. The performance of the alloys during the die filling step was assessed. The alloys were also assessed for sticking/soldering, hot tearing, shrinkage, and porosity. An overall rating was assigned to each alloy.

It should be appreciated that the foregoing description of the embodiments has been provided for purposes of illustration. In other words, the subject disclosure it is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of disclosure.

What is claimed is:

1. An aluminum alloy, consisting of, based on the total weight of the aluminum alloy:
- manganese in an amount of 1.7 to 1.9 wt. %,
- magnesium in an amount of 1.0 to 1.5 wt. %,
- iron in an amount of 0.0 to 0.2 wt. %,
- zinc in an amount of 1.5 to 3.0 wt. %,
- silicon in an amount of 0.0 to 2.5 wt. %,
- zirconium in an amount of 0.1 to 0.6 wt. %,
- at least one of titanium and boron in an amount of 0.0 to 0.2 wt. %,
- strontium in an amount of 0.0 to 0.05 wt. %,
- possibly impurities in an amount of not greater than 1.0 wt. %, and
- aluminum in an amount of 90.1 to 98.8 wt. %.

2. An aluminum alloy, consisting of, based on the total weight of the aluminum alloy:
- manganese in an amount of 1.74 to 1.87 wt. %,
- magnesium in an amount of 0.95 to 1.5 wt. %,
- iron in an amount of 0.14 to 0.21 wt. %,
- zinc in an amount of 1.41 to 3.04 wt. %,
- silicon in an amount of 0.02 to 2.46 wt. %,
- zirconium in an amount of 0.0 to 0.6 wt. %,
- titanium in an amount of 0.0 to 0.2 wt. %,
- boron in an amount of 0.0 to 0.11 wt. %,
- strontium in an amount of 0.0 wt. %,
- a balance of aluminum, except for possible impurities in an amount of not greater than 1.0 wt. %, and
- aluminum in an amount of 85.5 to 98.8 wt. %.

3. The aluminum alloy of claim 1, wherein the aluminum alloy is cast.

4. The aluminum alloy of claim 3, wherein the cast aluminum alloy has a yield strength of at least 90 MPa, an ultimate tensile strength of at least 180 MPa, and an elongation of at least 10%.

5. A cast part formed of an aluminum alloy, the aluminum alloy consisting of:
- manganese in an amount 1.2 to 2.0 wt. %,
- magnesium in an amount of 0.5 to 4.0 wt. %,
- iron in an amount of 0.0 to 1.0 wt. %,
- zinc in an amount of 0.0 to 3.5 wt. %,
- silicon in an amount of 0.0 to 3.0 wt. %, zirconium in an amount of 0.0 to 1.0 wt. %, at least one of titanium and boron in an amount of 0.0 to 0.5 wt. %, strontium in an amount of 0.0 to 0.05 wt. %, possibly impurities in an amount of not greater than 1.0 wt. %, and aluminum in an amount of 85.5 to 98.8 wt. %, wherein the cast part is a shock tower, rail, or battery tray for an automotive vehicle.

6. A cast part formed of an aluminum alloy, the aluminum alloy consisting of:

manganese in an amount of 1.7 to 1.9 wt. %, magnesium in an amount of 1.0 to 1.5 wt. %, iron in an amount of 0.0 to 0.2 wt. %, zinc in an amount of 1.5 to 3.0 wt. %, silicon in an amount of 0.0 to 2.5 wt. %, zirconium in an amount of 0.1 to 0.6 wt. %, at least one of titanium and boron in an amount of 0.0 to 0.2 wt. %, strontium in an amount of 0.0 to 0.05 wt. %, possibly impurities in an amount of not greater than 1.0 wt. %, and aluminum in an amount of 90.1 to 98.8 wt. %.

7. A cast part formed of an aluminum alloy, the aluminum alloy consisting of:

manganese in an amount of 1.74 to 1.87 wt. %, magnesium in an amount of 0.95 to 1.5 wt. %, iron in an amount of 0.14 to 0.21 wt. %, zinc in an amount of 1.41 to 3.04 wt. %, silicon in an amount of 0.02 to 2.46 wt. %, zirconium in an amount of 0.0 to 0.6 wt. %, titanium in an amount of 0.0 to 0.2 wt. %, boron in an amount of 0.0 to 0.11 wt. %, strontium in an amount of 0.0 wt. %, and a balance of aluminum, except for possible impurities in an amount of not greater than 1.0 wt. %.

* * * * *